United States Patent [19]

Kuczynski et al.

[11] 4,048,611

[45] Sept. 13, 1977

[54] THERMAL SWITCH

[76] Inventors: Walter J. Kuczynski, 871 Pennsylvania Ave.; Robert A. Kuczynski, 1075 W. Chestnut St., both of Union, N.J. 07083

[21] Appl. No.: 699,201

[22] Filed: June 23, 1976

[51] Int. Cl.[2] ..... H01H 37/52

[52] U.S. Cl. ..... 337/380; 337/343; 337/354; 337/365

[58] Field of Search ..... 337/343, 354, 362, 365, 337/380

[56] References Cited

U.S. PATENT DOCUMENTS

| | | | |
|---|---|---|---|
| 3,227,845 | 1/1966 | Barz | 337/354 |
| 3,297,845 | 1/1967 | Mertler | 337/380 X |

FOREIGN PATENT DOCUMENTS

| | | | |
|---|---|---|---|
| 1,100,734 | 1/1968 | United Kingdom | 337/380 |

*Primary Examiner*—Robert J. Hickey

*Attorney, Agent, or Firm*—Popper & Bobis

[57] ABSTRACT

A snap-action thermal switch having a housing with an open hollow portion at one end with a central enlargement of the housing in the hollow portion; a central cavity in the other end of the housing extending into the central enlargement; a pair of opposed slots communicating between the hollow portions; through the enlargement into the cavity with stationary contact in the hollow portion extending through the slot into the cavity; the widest points of the internal rectangular cavity being equal to or greater than the width of the enlargement.

9 Claims, 3 Drawing Figures

THERMAL SWITCH

BACKGROUND OF THE INVENTION

1. Field of the Invention

This invention relates generally to snap-action thermal switches and particularly to snap-action thermal switches wherein the cavity at one end of the housing for the switch has slots which communicate with a hollow portion at the other end of the housing for stationary contacts to extend through the slots.

2.

Numerous snap-action electro-switches responsive to changes in temperature of electro-switches have been devised and are presently commercially available. They have multi-part contact to terminal assemblies and are costly to manufacture, difficult to assemble, expensive, and very critical. They have a multi-part contact to terminal assembly resulting in an unduly large swtich relative to its function.

The housings in some type switches are usually made in several parts and require trained operators to assemble and fasten them together. The contact members and the terminal bars are separate and must be united together by rivets or staking. Such procedures add further to the cost of manufacture and assembling. Moreover, high precision dimensioning of the parts is necessary for such switches so that extremely close tolerances are required. Multi-part connections may result in higher resistance, especially in the case of high current applications. The particular construction may result in resistance arcing during such high current application.

Typical of the snap-action thermal switches which have one or more of the aforementioned problems are: Evans U.S. Pat. No. 2,238,881; Bolesky U.S. Pat. No. 2,717,936; Schmitt, U.S. Pat. No. 3,014,105; Colavecchio, U.S. Pat. No. 3,258,567; Mertler, U.S. Pat. No. 3,297,845; Ohlemacher, U.S. Pat. No. 3,470,517 and Manecke, U.S. Pat. No. 3,870,229.

SUMMARY OF THE INVENTION

It has been found that a snap-action thermal switch may be prepared with a single piece housing which can be readily molded. The switch can be drastically reduced in size and a number of parts eliminated therefrom. Insteand of a multi-part fixed contact to terminal assembly, the fixed contact terminal may be made of unitary construction, eliminating the need for riveting the various parts to secure them together. The subassembly, using fewer parts properly designed, provides for reduction of overall size of the snap-action thermal switch.

By reason of the reduction in the size of the housing, the switch becomes less obstrusive and can be designed more appealing aesthetically. Since there are fewer parts, low resistance connections are attained and possibility of arcing in high current applications is further reduced.

The internal and external cavities meet to provide slots, thereby permitting the easy insertion of the unitary fixed contact-terminal members.

DESCRIPTION OF THE DRAWINGS

These objects and advantages as well as other objects and advantages may be attained by the device shown by way of illustration in the drawings in which.

PREFERRED EMBODIMENT

Figure 2:
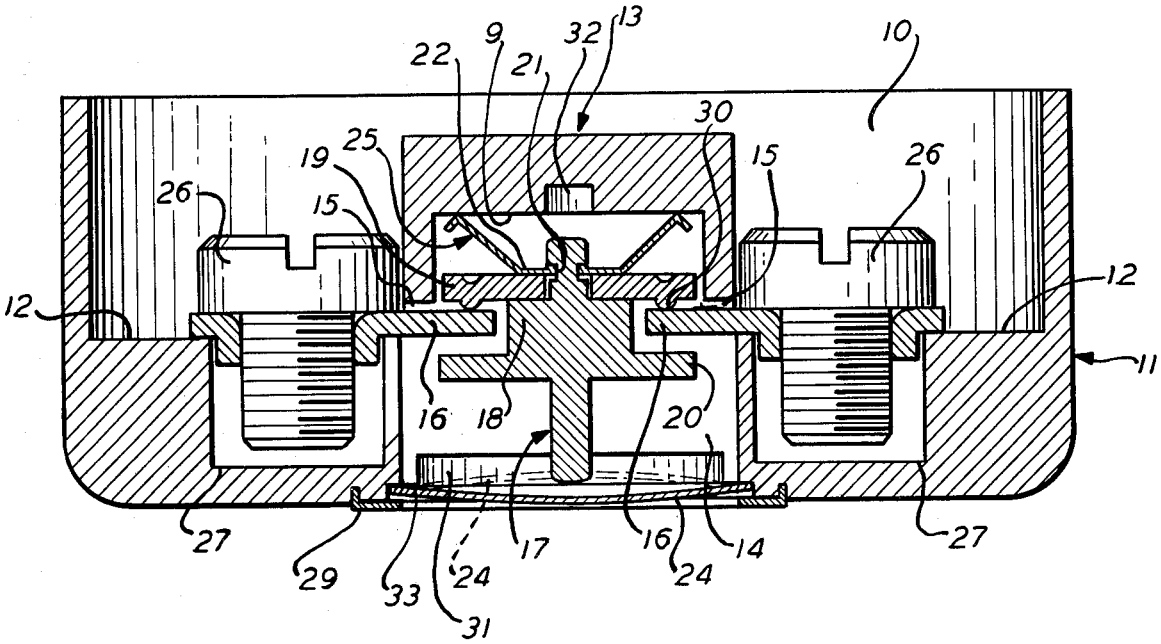
FIG. 2 is a vertical sectional view taken on the line 2—2 in FIG. 1, looking in the direction of the arrows.

Referring now to the drawings in detail, the snap-action thermal switch has a housing 11. The housing 11 has an open hollow portion 10 at one end. The closed end of the hollow portion 10 defines a floor 12. Extending into the hollow portion 10, there is a generally central enlargement 13 arising from the floor 12. The other side of the housing 11, has a general rectangular cavity 14. This cavity 14 extends into the enlargement 13.

The cavity 14 being basically two rectangular shapes with the same width and extends in length from a point above floor 11 and mates with the hollow portion 10, to form the slots 15. A pair of stationary contacts 16 are provided for placement in the hollow portion 10 of the housing 11, and extending through the slots 15 into the cavity 14.

A bumper button 17 is positioned in the cavity for axial movement. The bumper button 17 is a rod or piston, and has a radial flange 18 defining a seat for a movable contact member 19. The movable contact member 19 is a generally rectangular bus-bar and is dimensioned to bridge the stationary contacts 16 by engaging them to close a circuit. There is a generally rectangular extension or flange 20, on the bumper button 17.

The flange 18 on the bumper button has an overall diameter less than the distance between the stationary contacts 16, but the rectangular extension 20 has an overall length greter than the distance between the stationary contact 16, and less than the walls of the larger rectangular portion of cavity 14. The rectangular extension 20 acts as an arcing shield between contacts 16, and a thermostatic disc 24.

An annual channel 21 is provided on the bumper-button 17 immediately beyond the movable contact member 19, and defines a seat for a spring. A spring 22 having a circular aperture 23 is provided. The apertue 23 is slightly smaller than the diameter of the bumper-button 17 so that the spring 22 is seated in the annular channel 21. This is accomplished by providing a plurality of radial slits 8 around the apertue 23 so that the area around the apertue 23 may be deformed and be deflected slightly to permit the spring to slide down over the top of the bumper-button 17, until it is seated on the movable contact member 19 with its slits 8 positioned in the annular channel 21.

The movable contact 19 is provided with contact projections 30 at each end which define contact points for engagement with the stationary contacts 16. The spring 22 is provided with off-set arms 25. The spring 22 engages the movable contact 19. The arms 25 engage the closed end 9 of the cavity 14. Located on closed end 9 and adjacent to bumper-button 17 is a blind clearance hole 32 for the end of the bumper-button 17. The spring normally urges the movable contact 19 into engagement with the stationary contact 16.

A snap-action thermostatic disc 24 is positioned in a circular seat 30 with a clearance recess 31 at the open end of the cavity 14, which is held by retaining ring 29. The center of the disc 24 is a brief distance away from the bumper-button 17 at its concave position. A retainer ring 29 holds and captures the thermostatic disc 24 at the open end of the cavity 14.

Figure 1:
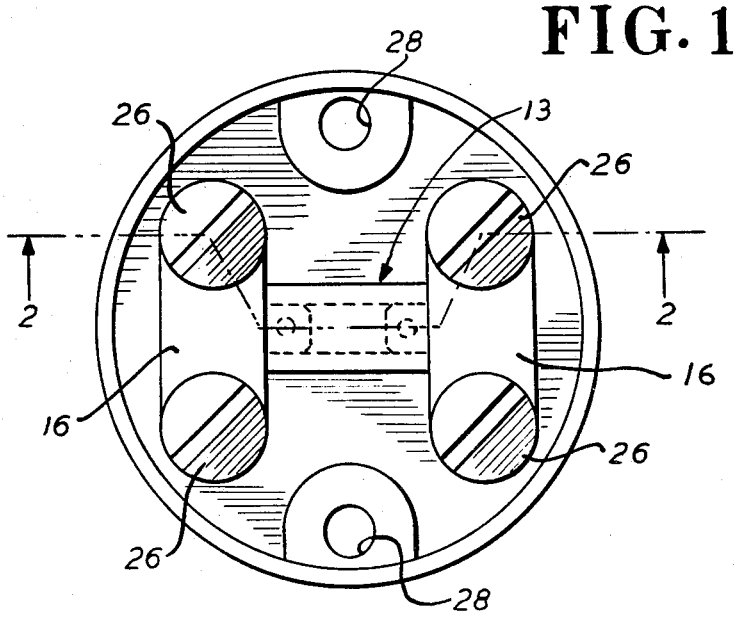
FIG. 1 is a rear view of the housing showing the stationary contacts and the central enlargement.
Figure 3:
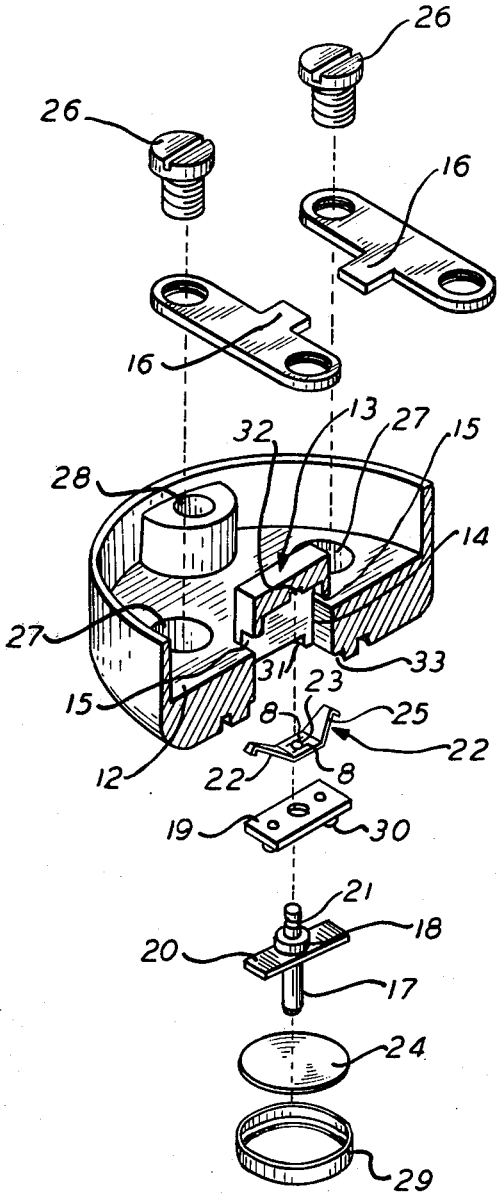
FIG. 3 is a partially sectioned exploded view showing the parts as they are related to each other prior to assembly.

The thermostatic disc 24 has two stabilized configurations responsive to higher or lower temperature. The first position may be concave as shown in FIG. 1 by the solid lines, permitting the bumper-button 17 to yield to the spring 22 and thus to engage the movable contact 19 to bridge the stationary contact 16 to complete a circuit.

The second stabilized position of the thermostatic disc 24 is convex with respect to the bumper-button 17 as shown by the dotted lines in FIG. 2. In this second position, the thermostatic disc 24 is convex and engages the end of the bumper-button 17 to overcome the spring and move the bumper-button 17 to disengage the movable contact member 19 from the stationary contact 16 thereby opening the circuit.

The thermostatic disc 24 is a bi-metallic plate which has its first stabilized configuration either convex or concave, depending on whether the snap-action thermal switch is to provide a normally opened or normally closed circuit.

The pair of stationary contact terminal bars 16 have drawn end portions in the hollow portion 10 and are provided with threaded bores for receiving screws 26 by means of which conductive wire may be attached to the stationary contact 16. There are pockets 27 in the floor 12 to accommodate the drawn portions 16 and screws 26. The contact terminal bars 16 may be fastened to floor 12 by any suitable means.

There are holes 28 in the housing to accommodate mounting by which the snap-action thermal switch can be attached to a suitable surface in a chosen area.

What is claimed is:

1. A thermal switch comprising:

a. a housing with an open hollow portion at one end, b. the end of the hollow portion defining a floor, c. an enlargement on the floor extending into the hollow portion, d. a cavity at the other end of the housing, extending into the enlargement, e. a pair of opposed slots communicating between the hollow portion of the housing, through the enlargement into the cavity, f. a switch means in the cavity responsive to temperature change.

2. A thermal switch according to claim 1 and a. the internal width of the cavity being larger at two points than the external dimension of the enlargement, whereby the housing, cavity and intercommunicating slots may be formed.

3. A thermal switch according to claim 1 and a. a pair of unitary stationary contact terminals in the hollow portion extending through the slots into the cavity.

4. A thermal switch comprising:

a. a housing with an open hollow portion at one end, b. the end of the hollow portion defining a floor, c. an enlargement on the floor extending into the hollow portion.

d. a cavity at the other end of the housing, extending into the enlargement, e. a pair of opposed slots communicating between the hollow portion of the housing, through the enlargement into the cavity, f. a pair of unitary stationary contact terminals in the hollow portion extending through the slots into the cavity, g. a bumper-button in the cavity, h. a radial flange on the bumper-button defining a seat for a movable contact-member, i. a bridging movable contact-member seated on the radial flange, and disposed on the stationary contacts, j. a generally rectangular arc suppressing bar integral with the bumper-button adjacent to the radial flange, k. an annular channel on the bumper-button defining a seat for a spring, l. a spring having an aperture seated in the annular channel, m. offset arms on the spring, n. the spring bearing on the movable contact, o. the offset arms engaging the end of the cavity, p. the spring normally urging the movable contact toward engagement with the stationary contacts, g. a snap-action thermostatic disc at the open end of the cavity, r. means to retain the snap-action thermostatic disc at the open end of the cavity, s. the snap-action thermostatic disc having two stabilized configurations responsive to higher or lower temperatures, t. the first configuration being concave opposite the end of the bumper-button to permit the bumper-button to yield to the spring, thereby engaging the movable contact to bridge and engage the stationary contacts to complete a circuit, u. the second configuration being convex and engaging the bumper-button and moving it to overcome the spring and to unseat the movable contact member out of engagement with the stationary contacts, to open a circuit.

5. A thermal switch according to claim 3 and a. the pair of stationary contacts having means for engaging electric conductors thereto.

6. A thermal switch according to claim 4 and a. the pair of stationary contacts having means for engaging electric conductors thereto.

7. A thermal switch according to claim 4 and a. the aperture in the spring having a diameter slightly smaller than the diameter of the bumper-button, b. a slit about the aperture in the spring defining deflectable leaves whereby the leaves may be deflected to permit the spring to slip down around the bumper-button until it is seated in the annular channel.

8. A thermal switch according to claim 4 and a. the movable contact member having mounds opposite the stationary contacts for engagement therewith.

9. A thermal switch comprising:

a. a housing having an open hollow portion at one end, b. a floor defined in the end of the hollow portion, c. a generally central enlargement on the floor extending into the hollow portion, d. a generally central cavity at the other end of the housing has a closed end extending into the enlargement, e. a pair of opposed slots communicating between the hollow portion through the enlargement into the cavity, f. a pair of stationary contacts extending from the hollow portion of the housing through the slots into the cavity, g. a bumper-button in the cavity, h. the bumper-button having a first radial flange, defining a seat for a bridging movable contact member, i. an arc suppressing bar on the bumper-button, j. a bridging movable contact-member seated on the flange, k. an annular channel on the bumper-button defining a seat for a spring, l. a spring having a circular aperture is in seating engagement with the channel, m. offset arms on the spring, n. the spring at the aperture engaging the movable contact, o. the arms engaging the closed end of the cavity, p. the spring normally urging the movable contact toward engagement with the stationary contacts, q. a snap-action thermostatic disc for actuating the bumper-button at the open end of the cavity, r. retaining means capturing the thermostatic disc at the open end of the cavity, s. the thermostatic disc having two stabilized configurations responsive to higher and lower temperatures.

t. the first configuration being concave, permitting the bumper-button to yield to the spring and to engage the movable contact to bridge the stationary contacts to complete a circuit, u. the pair of stationary contacts having means for attaching electric conductors thereto, v. the means being screws accommodated in pockets in the floor of the housing, w. a passage through the housing to accommodate a mounting means.

* * * * *